United States Patent [19]

Nakamura et al.

[11] Patent Number: 4,465,642

[45] Date of Patent: Aug. 14, 1984

[54] VARIABLE VENTURI-TYPE CARBURETOR

[75] Inventors: Norihiko Nakamura; Takashi Katou; Takaaki Itoh, all of Mishima; Toshiharu Morino, Mie, all of Japan

[73] Assignees: Toyota Jidosha Kabushiki Kaisha, Toyota; Aisan Industry Co., Ltd., Obu, both of Japan

[21] Appl. No.: 468,875

[22] Filed: Feb. 23, 1983

[30] Foreign Application Priority Data

Jul. 16, 1982 [JP] Japan ..... 57-122989

[51] Int. Cl.[3] ..... F02M 9/06

[52] U.S. Cl. ..... 261/44 C; 261/DIG. 56

[58] Field of Search ..... 261/44 C, 44 B, DIG. 56

[56] References Cited

U.S. PATENT DOCUMENTS 4,013,741 3/1977 Edmonston ..... 261/44 B
4,185,054 1/1980 Nakamura et al. ..... 261/44 C
4,302,404 11/1981 Nakamura et al. ..... 261/44 C
4,305,893 12/1981 Morino ..... 261/44 C
4,371,478 2/1983 Wada ..... 261/44 C

*Primary Examiner*—Tim R. Miles
*Attorney, Agent, or Firm*—Finnegan, Henderson, Farabow, Garrett & Dunner

[57] ABSTRACT

A variable venturi-type carburetor comprising a suction piston which has a tip face having an upstream end portion. A raised wall is formed on the inner wall of the intake passage. The upstream end portion of the suction piston cooperates with the tip edge of the raised wall to restrict the flow of air flowing within the intake passage. The upstream end portion of the suction piston has a V-shaped central portion and flat opposed end portions. The tip edge of the raised wall has a flat central portion cooperating with the V-shaped central portion of the suction piston and has opposed end portions cooperating with the flat opposed end portions of the suction piston and projecting towards the intake passage.

5 Claims, 9 Drawing Figures

VARIABLE VENTURI-TYPE CARBURETOR

BACKGROUND OF THE INVENTION

The present invention relates to a variable venturi-type carburetor.

The inventor previously proposed a variable venturi-type carburetor, illustrated in FIGS. 1 through 3, in which the upstream end portion b of the tip face of the suction piston a is formed so that it has a V-shaped cross section which expands towards the venturi portion c. A raised wall e is formed on the inner wall of the intake passage d, which faces the upstream end portion b of the tip face of the suction piston a, so that an air-inflow restricting opening f is formed between the raised wall e and the upstream end portion b of the tip face of the suction piston a. In this variable venturi-type carburetor, since the air-inflow restricting opening f has an approximately isosceles triangle shape, as is illustrated in FIG. 2, when the amount of air fed into the cylinder of the engine is small, the lift of the suction piston a is proportional to the amount of air fed into the cylinder of the engine, and, thus, when the amount of air fed into the cylinder of the engine is increased, the suction piston moves, without vibrating, in a direction where the cross-sectional area of the venturi portion c is increased. Consequently, in this variable venturi-type carburetor, even when the engine is accelerated, it is possible to feed fuel from the nozzle g into the intake passage d in an amount which is proportional to the amount of air fed into the cylinder of the engine. On the other hand, this variable venturi-type carburetor is constructed so that the upstream end portion b of the tip face of the suction piston a is completely covered by the raised wall e when the engine is started in order to increase the airflow resistance and thereby produce a great vacuum in the venturi portion c. In addition, this variable venturi-type carburetor is constructed so that the reduced-diameter portion i of the needle h is located within the metering jet j when the engine is started. As mentioned above, when the engine is started, since a great vacuum is produced in the venturi portion c and the reduced-diameter portion i of the needle h is located within the metering jet j, a large amount of fuel can be fed into the intake passage d from the nozzle g.

As will be understood from the above description, in this variable venturi-type carburetor, it is necessary to form the raised wall e so that the upstream end portion b of the tip face of the suction piston a is completely covered by the raised wall e. In order to accomplish this, it is necessary to increase the height of the raised wall e. However, it is impossible to increase the height of the raised wall e very much because when the height of the wall e is increased the airflow resistance becomes great. Therefore, in this variable venturi-type carburetor, the grooves k, into which the tip end of the suction piston a is able to enter, are formed on the inner wall of the intake passage d so that the upstream end portion b of the tip face of the suction piston a is completely covered by the raised wall e. However, a problem occurs in that the formation of such grooves k requires a complicated machining operation.

In order to eliminate such a problem, the inventor later proposed another variable venturi-type carburetor, illustrated in FIGS. 4 and 5, in which the upstream end portion b of the tip face of the suction piston a is formed so that it has a flat surface and in which the tip edge of the raised wall e is formed so that it has a V-shaped cross section. In this variable venturi-type carburetor, since the upstream end portion b of the tip face of the suction piston a has a flat surface, there is an advantage in that it is not necessary to form grooves for receiving the tip end of the suction piston a therein on the inner wall of the intake passage d. However, in this variable venturi-type carburetor, since the carburetor housing is formed by means of a casting operation, it is necessary to machine the raised wall e so that it has a predetermined or V-shaped cross section. In addition, since the raised wall e is located in the interior of the carburetor, a problem occurs in that it is difficult to machine the raised wall e.

It is possible to relatively easily form by means of a machining operation the tip face of the suction piston a so that it has a V-shaped cross section, as is illustrated in FIG. 2, because during machining the tip face of the suction piston a is exposed to the exterior of the carburetor body. Consequently, if the tip face of the suction piston a is formed so that it has a V-shaped cross section, and since it is not necessary to form grooves for receiving the tip end of the suction piston a therein on the inner wall of the intake passage d, manufacture of the carburetor is extremely easy.

SUMMARY OF THE INVENTION

An object of the present invention is to provide a variable venturi-type carburetor which can be easily manufactured in such a way that the tip face of the suction piston is so formed that it has a V-shaped cross section and it is not necessary to form grooves for receiving the tip end of the suction piston therein on the inner wall of the intake passage.

According to the present invention, there is provided a variable venturi-type carburetor comprising: an axially-extending intake passage formed in the carburetor and having an inner wall; a suction piston having a tip face which defines a venturi portion in the intake passage and being transversely movable in the intake passage in response to a change in the amount of air flowing within the intake passage; the tip face having an upstream end portion which has a central portion having a V-shaped cross section expanding towards the venturi portion and which has flat opposed end portions located on each side of the central portion; a fuel passage extending transversely and being open to the intake passage; a metering jet arranged in the fuel passage; a needle fixed onto the tip face of the suction piston and extending through the fuel passage and the metering jet; and a raised wall projecting into the intake passage and formed on the inner wall of the intake passage, which inner wall faces the upstream end portion of the tip face of the suction piston, the raised wall having a tip edge which has a flat central portion and opposed end portions arranged on each side of the flat central portion and projecting towards the intake passage relative to the flat central portion, the V-shaped central portion of the suction piston cooperating with the flat central portion of the raised wall and the flat opposed end portions of the suction piston cooperating with the projecting opposed end portions of the raised wall to restrict the flow of air flowing into the venturi portion.

The present invention may be more fully understood from the description of the preferred embodiments set forth below, together with the accompanying drawings.

DESCRIPTION OF THE PREFERRED EMBODIMENTS

Figure 1:
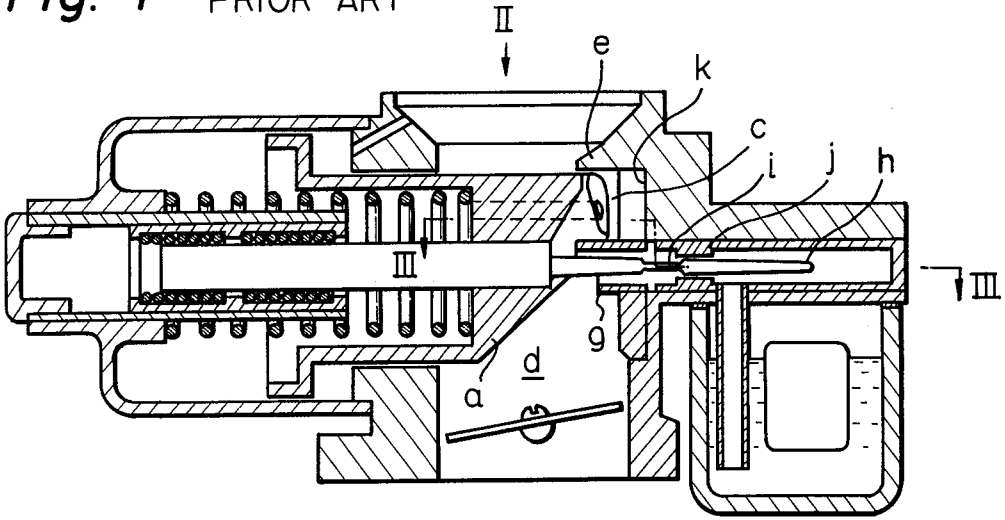
Fig. 1 PRIOR ART
FIG. 1 is a cross-sectional side view of a variable venturi-type carburetor previously proposed.

Referring to FIG. 1, reference numeral 1 designates a carburetor body, 2 a vertically-extending intake passage, 3 a suction piston transversely movable in the intake passage 2, and 4 a needle fixed onto the tip face of the suction piston 3. Reference numeral 5 designates an inner wall of the intake passage 2, which inner wall has an approximately uniform cross section over the entire length thereof, 6 a throttle valve, arranged in the intake passage 2 located downstream of the suction piston 3, and 7 a float chamber of the carburetor. A venturi portion 8 is formed between the inner wall 5 of the intake passage 2 and the tip face of the suction piston 3. A hollow cylindrical casing 9 is fixed onto the carburetor body 1, and a guide sleeve 10, extending within the casing 9 in the axial direction of the casing 9, is attached to the casing 9. A bearing 12, equipped with a plurality of balls 11, is inserted into the guide sleeve 10, and the outer end of the guide sleeve 10 is closed with a blind cap 13. A guide rod 14 is fixed onto the suction piston 3 and is inserted into the bearing 12 so as to be movable in the axial direction thereof. Since the suction piston 3 is supported by the casing 9 via the bearing 12, as mentioned above, the suction piston 3 is able to smoothly move in the axial direction thereof. The interior of the casing 9 is divided into a vacuum chamber 15 and an atomospheric pressure chamber 16 by the suction piston 3, and a compression spring 17 for continuously biasing the suction piston 3 towards the venturi portion 8 is inserted into the vacuum chamber 15. The vacuum chamber 15 is connected to the venturi portion 8 via a suction hole 18 formed in the suction piston 3, and the atmospheric pressure chamber 16 is connected to the intake passage 2, located upstream of the suction piston 3, via an air hole 19 formed in the carburetor body 1.

A fuel passage 20 is formed in the carburetor body 1 and extends in the axial direction of the needle 4 so that the needle 4 can enter into the fuel passage 20. A metering jet 21 is arranged in the fuel passage 20. The fuel passage 20, located upstream of the metering jet 21, is connected to the float chamber 7 via a downwardly-extending fuel pipe 22, and fuel in the float chamber 7 is fed into the fuel passage 20 via the fuel pipe 22. In addition, a hollow cylindrical nozzle 23, arranged coaxially to the fuel passage 20, is fixed onto the inner wall 5 of the intake passage 2. The nozzle 23 projects from the inner wall 5 of the intake passage 2 into the venturi portion 8, and the upper half of the tip portion of the nozzle 23 projects beyond the lower half of the tip portion of the nozzle 23 towards the suction piston 3. The needle 4 extends through the interior of the nozzle 23 and the metering jet 21, and fuel is fed into the intake passage 2 from the nozzle 23 after it is metered by an annular gap formed between the needle 4 and the metering jet 21.

Figure 6:
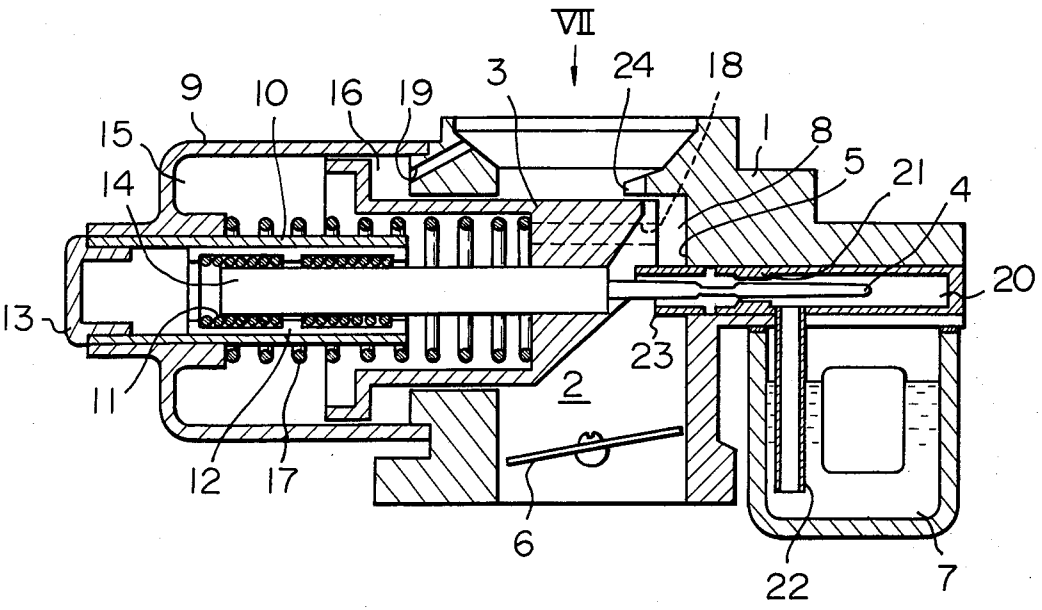
FIG. 6 is a cross-sectional side view of an embodiment of a variable venturi-type carburetor according to the present invention.

As is illustrated FIG. 6, a raised wall 24, projecting horizontally into the intake passage 2, is formed on the inner wall 5 of the intake passage 2, and the flow of air is controlled between the raised wall 24 and the tip end portion of the suction piston 3. When the engine is started, air flows downwards within the intake passage 2, and, since the airflow is restricted between the suction piston 3 and the raised wall 24, a vacuum is created in the venturi portion 8. This vacuum acts on the vacuum chamber 15 via the suction hole 18. The suction piston 3 moves so that the pressure difference between the vacuum in the vacuum chamber 15 and the pressure in the atomospheric pressure chamber 16 becomes approximately equal to a fixed value determined by the spring force of the compression spring 17, that is, the level of the vacuum created in the venturi portion 8 remains approximately constant.

Figure 7:
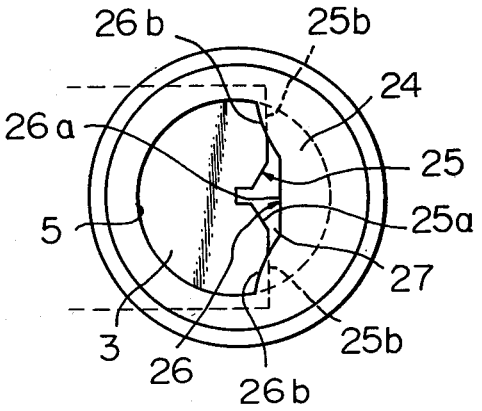
FIG. 7 is a plan view taken along the arrow VII in FIG. 6.

Referring to FIGS. 6 and 7, the central portion 25*a* of the upstream end portion 25 of the tip face of the suction piston 3 is formed so that it has a V-shaped cross section which expands towards the venturi portion 8, and the opposed end portions 25*b* of the upstream end portion 25 of the tip face of the suction piston 3 are formed so that they have a flat face. On the other hand, the central portion 26*a* of the tip edge 26 of the raised wall 24, which central portion faces the central portion 25*a* of the upstream end portion 25 of the tip face of the suction piston 3, is formed so that it has a flat face, and the opposed end portions 26*b* of the tip edge 26 of the raised wall 24, which opposed end portions 26*b* face the opposed end portions 25*b* of the upstream end portion 25 of the tip face of the suction piston 3, project towards the intake passage 2.

Figure 2:
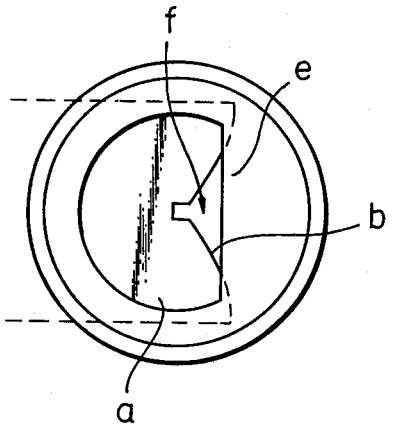
Fig. 2 PRIOR ART
FIG. 2 is a plan view taken along the arrow II in FIG. 1.
Figure 3:
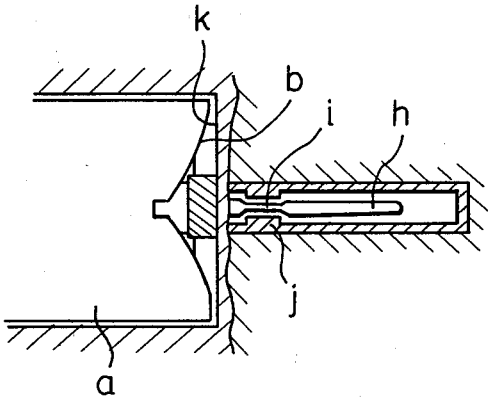
Fig. 3 PRIOR ART
FIG. 3 is a cross-sectional plan view taken along the line III—III in FIG. 1.
Figure 4:
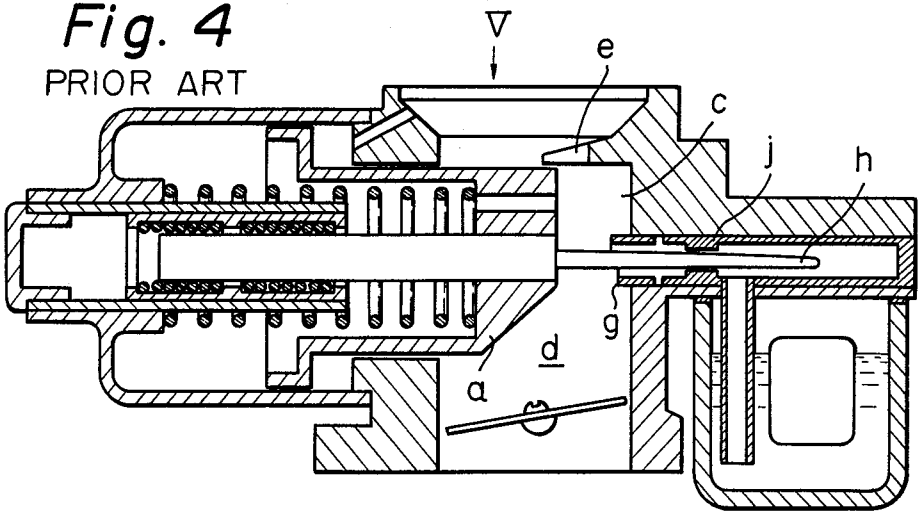
Fig. 4 PRIOR ART
FIG. 4 is a cross-sectional side view of another variable venturi-type carburetor previously proposed.
Figure 5:
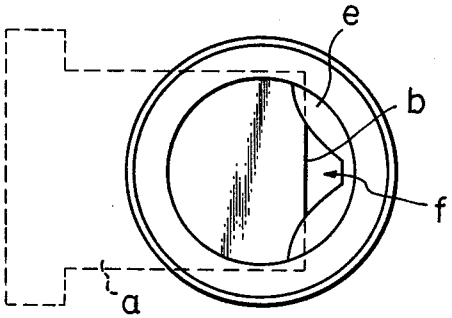
Fig. 5 PRIOR ART
FIG. 5 is a plan view taken along the arrow in FIG. 4.
Figure 8:
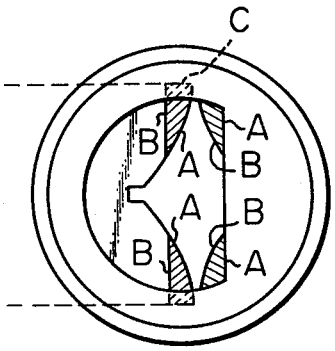
FIG. 8 is a plan view illustrating the shape of the tip face of the suction piston and the shape of the raised wall.

In FIG. 8, the solid lines A indicate the upstream end portion b of the tip face of the suction piston a and the tip edge of the raised wall e illustrated in FIG. 2, and the solid lines B indicate the upstream end portion 25 of the tip face of the suction piston 3 and the tip edge 26 of the raised wall 24, according to the present invention, illustrated in FIG. 7. As can be seen from FIG. 8, according to the present invention, in the opposed end portions 25*b* of the upstream end portion 25 of the tip face of the suction piston 3 the portions illustrated by the hatching c, are omitted from the suction piston a illustrated in FIG. 2, and in the opposed end portions 26*b* of the tip edge 26 of the raised wall 24 according to the present invention, the omitted portions c are added to the tip edge of the raised wall e illustrated in FIG. 2. That is, the height of the opposed end portions 26*b* of the tip edge 26 of the raised wall 24 relative to the central portion 25*a* is gradually increased as the measuring point on the opposed end portions 26*b* is moved away from the central portion 25*a*. Consequently, the flow area of an air-inflow restricting opening 27 formed between the tip edge 26 of the raised wall 24 and the upstream end portion 25 of the tip face of the suction piston 3 according to the present invention becomes equal to the flow area of the air-inflow restricting opening f illustrated in FIG. 2 irregardless of the position of the suction piston 3. As a result, in the variable venturi-type carburetor according to the present invention, the lift of the suction piston 3 is proportional to the amount of air fed into the cylinder of the engine is increased, the suction piston 3 is able to smoothly move, without vibrating, in a direction where the cross-sectional area of the venturi portion 8 is increased. In addition, since the opposed end portions **25*b* of the upstream end portion 25 of the tip face of the suction piston 3 are formed so that they have a flat face, it is not necessary to form grooves for receiving the tip end of the suction piston 3 therein on the inner wall of the intake passage 2**. Consequently, it is possible to easily manufacture the carburetor.

Figure 9:
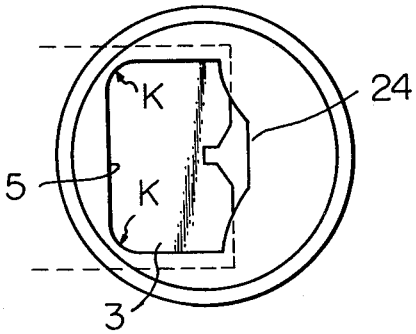
FIG. 9 is a plan view of an alternative embodiment of a variable venturi-type carburetor according to the present invention.

In the embodiment illustrated in FIG. 7, the intake passage 2 has a circular cross section. However, in order to prevent an increase in flow resistance, which is caused by the projecting opposed end portions **26*b* of the tip edge 26 of the raised wall 24, the inner wall 5 of the intake passage 2 may be formed so that the portions k thereof expand outward by as illustrated in FIG. 9**.

According to the present invention, it is not necessary to form grooves for receiving the tip end of the suction piston therein on the inner wall of the intake passage, and, as a result, it is possible to easily manufacture the carburetor.

Although the invention has been described with reference to specific embodiments chosen for purposes of illustration, it should be apparent that numerous modifications could be made thereto by those skilled in the art without departing from the basic concept and scope of the invention.

We claim:

1. A variable venturi-type carburetor comprising:

an axially-extending intake passage formed in the carburetor and having an inner wall;

a suction piston having a tip face which defines a venturi portion in said intake passage and being transversely movable in said intake passage in response to a change in the amount of air flowing within said intake passage, said tip face having an upstream end portion which has a central portion having a V-shaped cross section expanding towards said venturi portion and which has flat opposed end portions located on each side of said central portion;

a fuel passage extending transversely and being open to said intake passage;

a metering jet arranged in said fuel passage;

a needle fixed onto the tip face of said suction piston and extending through said fuel passage and said metering jet; and a raised wall projecting into said intake passage and formed on the inner wall of said intake passage, which inner wall faces the upstream end portion of the tip face of said suction piston, said raised wall having a tip edge which has a flat central portion and opposed end portions arranged on each side of said flat central portion and projecting towards said intake passage relative to said flat central portion, the V-shaped central portion of said suction piston cooperating with the flat central portion of said raised wall and the flat opposed end portions of said suction piston cooperating with the projecting opposed end portions of said raised wall to restrict the flow of air flowing into said venturi portion.

2. A variable venturi-type carburetor according to claim 1, wherein a portion enclosed by the tip edge of the projecting opposed end portions of said raised wall, an extension of the tip edge of the flat central portion of said raised wall, and an extension of the inner wall of said intake passage has an approximately triangular shape.

3. A variable venturi-type carburetor according to claim 1, wherein the inner wall of said intake passage located downstream of said raised wall has an approximately uniform cross section over the entire length thereof.

4. A variable venturi-type carburetor according to claim 1, wherein the tip face of said suction piston has a groove formed thereon and extending downwardly from the upstream end portion of said suction piston along the axis of said intake passage.

5. A variable venturi-type carburetor according to claim 4, wherein the tip face of said suction piston, which is located upstream of said needle, has a V-shaped cross section which expands towards said venturi portion.

* * * * *